US005452777A

United States Patent [19]

Giovannella

[11] Patent Number: 5,452,777

[45] Date of Patent: Sep. 26, 1995

[54] TRIMMING ACCESSORIES FOR TRAVEL BAGS, SUITCASES AND THE LIKE

[75] Inventor: Gioia Giovannella, Bologna, Italy

[73] Assignee: Finduck S.r.l., Bologna, Italy

[21] Appl. No.: 172,955

[22] Filed: Dec. 27, 1993

[30] Foreign Application Priority Data

Jan. 7, 1993 [IT] Italy ..... BO93U0001 U

[51] Int. Cl.[6] ..... A45C 13/02

[52] U.S. Cl. ..... 190/102; 190/110; 190/125; 150/113

[58] Field of Search ..... 190/102, 125, 190/109, 110, 111; 150/113, 117

[56] References Cited

U.S. PATENT DOCUMENTS

| | | | |
|---|---|---|---|
| 1,039,902 | 10/1912 | Cook | 190/102 X |
| 1,277,785 | 9/1918 | Urband | 190/102 |
| 1,368,084 | 2/1921 | Wolff | 190/102 X |
| 2,055,569 | 9/1936 | Zolotow | 150/113 |
| 3,023,794 | 3/1962 | Lifton | 190/109 X |
| 4,171,011 | 10/1979 | Kopin | 150/117 |
| 4,236,559 | 12/1980 | Archbold | 190/111 X |
| 4,828,081 | 5/1989 | Nordstrom | 190/125 X |
| 4,830,153 | 5/1989 | Saliba | 190/102 |
| 4,854,732 | 8/1989 | Italici | 190/115 X |
| 5,160,001 | 11/1992 | Marceau | 190/111 |
| 5,219,075 | 6/1993 | White | 190/125 X |
| 5,228,547 | 7/1993 | Yoo | 190/111 X |
| 5,265,719 | 11/1993 | Wand | 190/125 X |

FOREIGN PATENT DOCUMENTS

| | | | |
|---|---|---|---|
| 1125345 | 3/1962 | Germany | 190/125 |
| 612215 | 11/1948 | United Kingdom . | |

*Primary Examiner*—Allan N. Shoap
*Assistant Examiner*—Christopher T. McDonald
*Attorney, Agent, or Firm*—Guido Modiano; Albert Josif

[57] ABSTRACT

The trimming for bags and suitcases includes a protective panel made of padded material suitable to be applied to the front face of the bags and lies longitudinally to the front face, so as to partially follow its border; at least one slit is formed on the protective panel and constitutes the opening of a compartment for accommodating a partially extractable card on which appropriate identification data can be written.

18 Claims, 1 Drawing Sheet

TRIMMING ACCESSORIES FOR TRAVEL BAGS, SUITCASES AND THE LIKE

BACKGROUND OF THE INVENTION

The present invention relates to a set of trimming accessories for travel bags, suitcases and the like.

As is known, bags and suitcases made of flexible material, particularly tough fabric and the like, are currently in widespread use. These bags and suitcases are often formed so as to provide a plurality of compartments and have external pockets and the like.

In producing these bags it is generally necessary to provide some regions with appropriate protective or stiffening elements, particularly at the regions that are most intensely stressed or exposed to impacts, such as the couplings of carrying or towing handles.

SUMMARY OF THE INVENTION

A principal aim of the present invention is to provide optimum trimming of luggage items as bags and suitcases, particularly contributing to protect and stiffen their most exposed parts.

Within the scope of this aim, a particular object of the present invention is to provide a trimming for bags and suitcases which is simple in concept, very tough, and reliable and versatile in use.

With this aim and this object in view, there is provided, according to the invention, trimming for bags, suitcases and the like, which is characterized in that it comprises a protective panel made of padded material that can be applied to the front face of said bags and lies longitudinally to said front face, so as to partially follow its border, at least one slit being formed on said protective panel and constituting the opening of a compartment for accommodating a partially extractable card on which appropriate identification data can be written.

The trimming furthermore comprises a reinforcement element constituted by a strip of thermoformed plastic material which is suitable to be applied to the upper surface of said bags and forms a pair of bulges arranged symmetrically with respect to a concave central region which is meant to act as seat for the handle of said bags.

BRIEF DESCRIPTION OF THE DRAWINGS

The characteristics and advantages of the invention will become apparent from the following detailed description of a preferred embodiment thereof, illustrated only by way of non-limitative example in the accompanying drawings, wherein.

DESCRIPTION OF THE PREFERRED EMBODIMENTS

Figure 1:
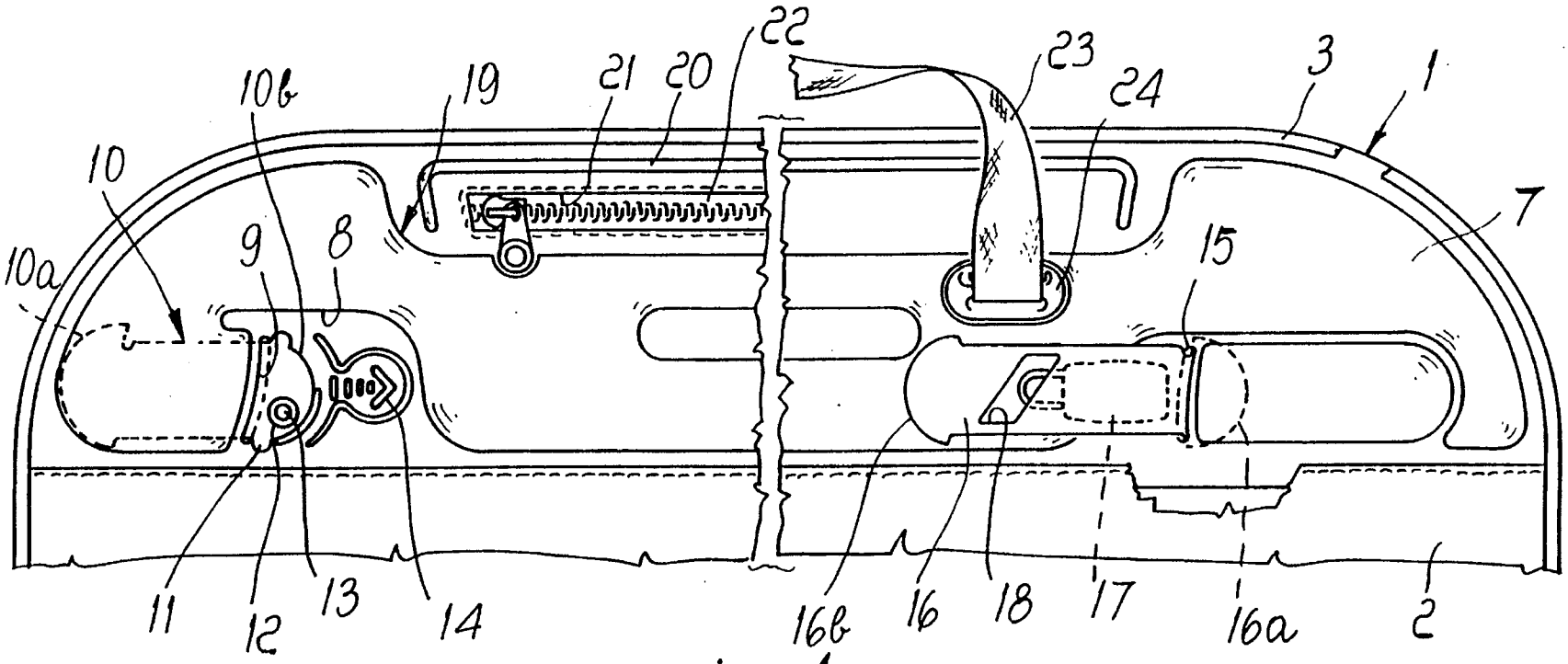
FIG. 1 is a side view of a front protective panel of the suitcase trimming according to the invention.

With reference to the above figures, the reference numeral 1 designates a protective panel which is applicable to the front face 2 of bags and the like, particularly made of fabric. The panel 1 lies so as to protect the upper region of the front face 2 and follows the rounded profile of its border, which is conveniently surrounded by a beading 3.

Figure 2:
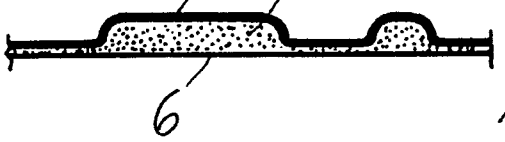
FIG. 2 is a transverse sectional view of a portion of the protective panel of FIG. 1.

As shown in the sectional view of FIG. 2, the protective panel 1 comprises a strip of padded material which is composed of an outer wall 4 made of a thermoplastic material treated appropriately so as to give stability to its color, by an intermediate layer structure 5 of foamed material, and by an inner wall 6 of fabric that is meant to ensure tear-resistance. The outer wall 4 and the inner one 6 are high-frequency welded so as to be mutually connected at least in a peripheral region, so as to compress the intermediate layer 5; the panel is rigidly coupled to the front and side of the bag along the borders of said peripheral region by means of conventional stitches or the like.

The portion where the walls 4 and 6 are not welded instead forms a padded region 7 which is shaped so as to at least partially follow the profile of the panel.

A slit 9 is formed on one side of the panel 1, at a lower recess 8 of the padded region 7, and constitutes the opening of a first compartment for accommodating a card 10 on which owner identification data can be written: this compartment is formed with respect to the underlying wall of the bag.

The card 10, made of semirigid plastic material, has two arc-shaped heads **10*a*, 10*b* at its ends. The first head 10*a* is larger, so as to form shoulders suitable to form extraction prevention means to prevent the full extraction of the card 10 from the slit 9, whereas the second head 10*b* is limited by lugs 11 and forms the flap for gripping the card 10**.

A hole 12 is formed in the second head **10*b* and provides the engagement seat for a pin 13 that protrudes from the panel 1 and is suitable to retain the card 10 in the normal position in which it is inserted in its compartment. In order to remove the card 10, it is therefore necessary to slightly bend the card 10 outwards. Conveniently, a graphic symbol 14, indicating the direction of extraction of the card 10 is impressed on the panel 1 in front of the slit 9**.

Another slit 15 is conveniently formed on the side opposite to the compartment of the card 10 and constitutes the opening of an associated second compartment located sideways of the first compartment for accommodating a pouch 16 which constitutes a means which is meant to contain a padlock 17 for the bag.

The pouch 16, preferably made of flexible plastic material with a transparent face, has two expanded arc-shaped heads **16*a***, 16*b* at its ends. The first head **16*a* is suitable to prevent the complete extraction of the pouch 16 from the slit 15, whereas the second head 16*b*** forms the flap for gripping said pouch.

The pouch 16 furthermore has an opening 18 for inserting and removing the padlock 17.

In its upper part, the padded region 7 has a depression 19 that extends longitudinally along most of the length of said padding. Said depression 19 is faced by a ridge 20 that follows the shape of the outer surface of the panel 1. A longitudinal slot 21 can be provided at the region delimited by said ridge 20 and constitutes the opening of a pocket that lies below the panel 1; said opening is conveniently closed by means of a slide fastener 22.

If the bag has carrying straps 23, associated coupling studs 24 therefor are mounted so as to pass through the panel 1 and clamp it at the padded region 7.

To conclude, the described set of trimming elements allows to complete in a versatile manner a wide range of travel bags, suitcases and the like, particularly ensuring adequate protection to the regions that are most intensely subjected to impacts and eliminating the presence of protruding parts.

In the practical embodiment of the invention, the materials employed, as well as the shape and the dimensions, may be any according to the requirements.

I claim:

1. Trimming for a luggage item of the type having a front face and a border, said trimming comprising:

a protective panel which is applyable to said front face of the luggage item for partially following said border, said panel being composed of an outer wall, an intermediate layer structure and an internal wall, said outer and inner walls being mutually connected at least in a peripheral region thereof for compressing the intermediate layer structure and forming a padded region; p1 a first compartment provided at said protective panel; at least one slit formed on said protective panel, said slit constituting an opening of said compartment; and a card on which appropriate identification data is writable, said card being accommodatable in said compartment and having extraction prevention means for preventing complete extraction of the card from said slit.

2. Trimming according to claim 1, wherein said outer wall is made of thermoplastic material, said intermediate layer structure is made of foamed material and said internal wall of tear-resistent fabric, said outer and inner walls being high-frequency welded at least in a peripheral region thereof, so as to form the padded region that is shaped so as to at least partially follow the profile of said protective panel.

3. Trimming according to claim 1, further comprising:

a second compartment being locatable on said front face of said luggage item and sideways of said first compartment;

an additional slit that constitutes an opening of said second compartment;

a pouch being accommodate in said second compartment; and a padlock contained in said pouch; wherein said pouch has at its ends, a pair of expanded arc-shaped heads, a first head of said heads preventing a complete extraction of said pouch from said slit, and a second head forming a grip flap of the pouch.

4. Trimming according to claim 1, wherein said card, is made of semirigid plastic material and has a pair of arc-shaped heads at it ends, a first head of said heads having an increased size for forming shoulders, said shoulders constituting said extraction prevention means that are adapted to prevent the full extraction of said card from said slit, and a second head forming a grip flap of said card.

5. Trimming according to claim 4, wherein a hole is formed in said second head and forms a seat for a coupling of a pin that protrudes from the outer wall of said protective panel for retaining said card in a normal position in which the card is inserted in the first compartment.

6. Trimming according to claim 1, wherein said slit is formed on one side of said protective panel at a lower recess of the padded region, a graphic symbol being provided in front of said slit, said symbol indicating a direction of extraction of said card.

7. Trimming according to claim 1, further comprising:

a longitudinally lying depression of the padded region;

a ridge facing said depression, said ridge following a shape of the outer wall of said panel for delimiting at said depression a region;

a pocket lying below said panel;

a longitudinal slot being formed at said region delimited by said ridge, said slot constituting an opening of said pocket;

a slide fastener for closing said pocket.

8. Trimming according to claim 1, further comprising carrying straps and coupling studs, said studs being mounted to pass through said panel for clamping said straps to said padded region.

9. Trimming according to claim 1, wherein said outer wall is made of thermoplastic material, said intermediate layer structure is made of foamed material and said internal wall of tear-resistent fabric, said outer and inner walls being high-frequency welded at least in a peripheral region thereof, so as to form the padded region that is shaped so as to at least partially follow the profile of said protective panel.

10. Trimming for a luggage item of the type having a front face and a border, said trimming comprising:

a protective panel which is applyable to said front face of the luggage item for partially following said border, said panel being composed of an outer wall, an intermediate layer structure and an internal wall, said outer and inner walls being mutually connected at least in a peripheral region thereof for compressing the intermediate layer structure and forming a padded region;

a compartment provided at said protective panel;

a slit that constitutes an opening of said compartment;

a pouch being accommodate in said compartment; and a padlock contained in said pouch;

wherein said pouch has at its ends a means for preventing a complete extraction of said pouch from said slit.

11. Trimming according to claim 10, further comprising:

an additional compartment being locatable on said front face of said luggage item and sideways of said compartment for accommodating said pouch, said additional compartment constituting a first compartment and said compartment for accommodating said pouch constituting a second compartment;

an additional slit that constitutes an opening of said first compartment;

a card on which appropriate identification data is writable, said card being accommodatable in said first additional compartment and having extraction prevention means for preventing complete extraction of the card from said additional slit.

12. Trimming according to claim 10, wherein said pouch has, at its ends, a pair of expanded arc-shaped heads, a first head constituting said means for preventing the complete extraction of said pouch from said slit, and a second head forming a grip flap of the pouch.

13. Trimming according to claim 11, wherein said card, is made of semirigid plastic material and has a pair of arc-shaped heads at it ends, with a first head having an increased size for forming shoulders, said shoulders constituting extraction prevention means that are adapted to prevent a full extraction of said card from said additional slit, and a second head forming a grip flap of said card.

14. Trimming according to claim 13, wherein a hole is formed in said second head and forms a seat for a coupling of a pin that protrudes from the outer wall of said protective panel for retaining said card in a normal position in which the card is inserted in the first compartment.

15. Trimming according to claim 10, wherein said slit is formed on one side of said protective panel at a lower recess of the padded region.

16. Trimming according to claim 10, further comprising:

a longitudinally lying depression of the padded region;

a ridge facing said depression, said ridge following a shape of the outer wall of said panel for delimiting at said depression a region;

a pocket lying below said panel;

a longitudinal slot being formed at said region delimited by said ridge, said slot constituting an opening of said pocket;

a slide fastener for closing said pocket.

17. Trimming according to claim 10, further comprising carrying straps and coupling studs, said studs being mounted to pass through said panel for clamping said straps to said padded region.

18. Trimming for a luggage item of the type having a front face and a border, said trimming comprising: a protective panel which is applyable to said front face of the luggage item for partially following said border;

a compartment provided at said protective panel;

a slit that constitutes an opening of said compartment;

a pouch being accommodate in said compartment; and a padlock contained in said pouch;

wherein said pouch has at its ends a means for preventing a complete extraction of said pouch from said slit.

* * * * *